US009422713B2

(12) United States Patent
Trebil

(10) Patent No.: US 9,422,713 B2
(45) Date of Patent: Aug. 23, 2016

(54) IN-SITU FABRICATED WALL FRAMING AND INSULATING SYSTEM

(71) Applicant: Jesse B. Trebil, Atwater, MN (US)

(72) Inventor: Jesse B. Trebil, Atwater, MN (US)

( * ) Notice: Subject to any disclaimer, the term of this patent is extended or adjusted under 35 U.S.C. 154(b) by 0 days.

(21) Appl. No.: 14/197,116

(22) Filed: Mar. 4, 2014

(65) Prior Publication Data

US 2014/0250828 A1 Sep. 11, 2014

Related U.S. Application Data

(60) Provisional application No. 61/851,417, filed on Mar. 6, 2013.

(51) Int. Cl.

| | |
|---|---|
| ***E04B 1/76*** | (2006.01) |
| ***E04B 1/00*** | (2006.01) |
| *E04B 2/74* | (2006.01) |

(52) U.S. Cl.

CPC ..... *E04B 1/7675* (2013.01); *E04B 1/0007* (2013.01); *E04B 2/7453* (2013.01)

(58) Field of Classification Search

CPC ..... E04B 2/7457; E04B 2/06; E04B 1/0007; E04B 1/7675

USPC ..... 52/309.4, 309.7, 309.9, 220.1–220.3, 52/220.7, 220.8

See application file for complete search history.

(56) References Cited

U.S. PATENT DOCUMENTS

| | | | | |
|---|---|---|---|---|
| 3,255,563 | A * | 6/1966 | Sauer | E04B 2/7403 52/220.7 |
| 3,537,219 | A * | 11/1970 | Navarre | 52/481.2 |
| 4,103,463 | A * | 8/1978 | Dixon | E04B 2/824 52/126.4 |
| 4,109,436 | A | 8/1978 | Berloty | |
| 4,430,834 | A * | 2/1984 | Rensch | E04B 1/24 52/281 |
| 4,628,650 | A | 12/1986 | Parker | |
| 4,637,187 | A | 1/1987 | Campbell | |
| 4,862,660 | A * | 9/1989 | Raymond | 52/220.2 |
| 5,279,089 | A | 1/1994 | Gulur | |
| 5,353,560 | A | 10/1994 | Heydon | |
| 5,822,940 | A | 10/1998 | Carlin et al. | |
| 5,913,788 | A * | 6/1999 | Herren | 52/241 |
| 6,167,624 | B1 * | 1/2001 | Lanahan et al. | 29/897.32 |

(Continued)

OTHER PUBLICATIONS

Magic Wall basement finishing system, product information from website www.magicwallsystem.com, printed on Dec. 31, 2014, but the described wall product is believed to have been commercially available to the public prior to Mar. 6, 2013, 5 pages.

*Primary Examiner* — Joshua J Michener
*Assistant Examiner* — Alp Akbasli
(74) *Attorney, Agent, or Firm* — Skaar Ulbrich Macari, P.A.

(57) ABSTRACT

A wall system for basements includes a horizontally-extending floor member defining an upwardly facing channel. A first vertically-extending support beam is coupled to the floor member and defines a pair of laterally-adjacent channels separated by a center rib. A second similar support beam is laterally displaced along the floor member with respect to the first support beam. A foam panel is disposed in the upwardly facing channel of the floor member and in one of the laterally-adjacent channels of the first support beam and in one of the laterally-adjacent channels of the second support beam. The floor member, first support beam and second support beam comprise a non-organic plastic material. The foam panel comprises a closed-cell non-organic foam material. The wall system can be formed in-situ and can be configured as a free-standing wall.

17 Claims, 8 Drawing Sheets

(56) References Cited

U.S. PATENT DOCUMENTS

| | | | | |
|---|---|---|---|---|
| 6,176,053 | B1 * | 1/2001 | St. Germain | 52/232 |
| 6,408,594 | B1 * | 6/2002 | Porter | 52/794.1 |
| 6,854,237 | B2 * | 2/2005 | Surowiecki | 52/633 |
| 7,032,356 | B2 | 4/2006 | Layfield | |
| 7,543,419 | B2 * | 6/2009 | Rue | 52/630 |
| 7,841,145 | B2 * | 11/2010 | Pervan et al. | 52/395 |
| 8,046,971 | B2 | 11/2011 | Lima | |
| 8,109,058 | B2 * | 2/2012 | Miller | 52/309.7 |
| 8,621,798 | B2 | 1/2014 | Dayton | |
| 8,635,824 | B2 | 1/2014 | Scherrer | |
| 2002/0108336 | A1 * | 8/2002 | Maimon et al. | 52/309.9 |
| 2002/0189172 | A1 * | 12/2002 | Kaeser | E04B 2/82 52/64 |
| 2003/0150183 | A1 * | 8/2003 | Egan | 52/506.05 |
| 2004/0134162 | A1 * | 7/2004 | Douglas | E02D 27/02 52/741.1 |
| 2005/0183361 | A1 * | 8/2005 | Frezza | E02D 27/00 52/293.3 |
| 2006/0123723 | A1 * | 6/2006 | Weir et al. | 52/302.1 |
| 2006/0137293 | A1 * | 6/2006 | Klein | 52/782.1 |
| 2007/0011969 | A1 * | 1/2007 | Little | E04B 2/7457 52/415 |
| 2007/0163191 | A1 * | 7/2007 | Berry | E04B 2/7457 52/281 |
| 2007/0193143 | A1 * | 8/2007 | Antonic | E02D 27/02 52/241 |
| 2007/0294974 | A1 * | 12/2007 | Tonyan et al. | 52/481.1 |
| 2008/0168728 | A1 * | 7/2008 | Scherrer | E04B 1/7608 52/309.11 |
| 2009/0077916 | A1 * | 3/2009 | Scuderi | E04B 1/0007 52/309.9 |
| 2009/0094923 | A1 * | 4/2009 | Weir et al. | 52/506.01 |
| 2009/0107065 | A1 * | 4/2009 | LeBlang | 52/252 |
| 2009/0165416 | A1 * | 7/2009 | Porter | E04B 2/7453 52/481.1 |
| 2012/0186174 | A1 * | 7/2012 | LeBlang | 52/220.1 |

* cited by examiner

IN-SITU FABRICATED WALL FRAMING AND INSULATING SYSTEM

PRIORITY

This application claims the priority benefit of U.S. Provisional Application No. 61/851,417 filed on Mar. 6, 2013, which is hereby incorporated herein by reference in its entirety.

FIELD

The present invention relates, in general, to in-situ fabricated walls and methods of installation, and more particularly to an in-situ fabricated wall structure that can be installed anywhere inside an existing facility independent of the placement of the current wall structures.

BACKGROUND

Basements of houses and buildings have a tendency to leak water and condensate moisture. Thus traditional construction methods for finishing basements (e.g. wood framing and batt insulation) have a tendency to fail due to their material composition. These porous materials tend to absorb or soak up moisture. Wood and other organic materials rot and promote mold growth. These issues cause structural failure and create unsafe living conditions due to mold spores and the associated health issues. Thus, there is a need to provide for wall systems for finishing basements that address these deficiencies.

SUMMARY

The invention, in certain embodiments, addresses the drawbacks of the prior art by providing a wall system, assembly and method of creating a basement wall. In certain embodiments, a wall system for basements includes a horizontally-extending floor member defining an upwardly facing channel. A first vertically-extending support beam is coupled to the floor member and defines a pair of laterally-adjacent channels separated by a center rib. A second similar support beam is laterally displaced along the floor member with respect to the first support beam. A foam panel is disposed in the upwardly facing channel of the floor member and in one of the laterally-adjacent channels of the first support beam and in one of the laterally-adjacent channels of the second support beam. The floor member, first support beam and second support beam comprise a non-organic plastic material. The foam panel comprises a closed-cell non-organic foam material. The wall system can be formed in-situ and can be configured as a free-standing wall.

Another embodiment of the present invention describes an in-situ fabricated rectangular room comprising pre-built foam panels of varying height and width, means to attach the said foam panels side by side, subsequent means to mechanically adhere the bottom surface of the said foam panels to the room floor, means to mechanically adhere the top surface of the said foam panels to the room ceiling, means to attach said foam panels at right angles, and enclosing a floor space utilizing a combination of linear side-by-side attached foam panels terminated on four corners with foam panels attached at right angles.

Another embodiment of the present invention describes an in-situ fabricated room comprising pre-built high density polyethylene panels of varying height and width, means to attach the said panels side by side, means to mechanically adhere the bottom surface of the said panels to the room floor, and means to mechanically adhere the top surface of the said panels to the room ceiling.

In yet another embodiment, a method of assembling a wall in a basement includes disposing a non-organic plastic horizontally-extending floor member along a floor of the basement. A non-organic plastic first support beam is coupled to the floor member and oriented in a vertical direction. A non-organic plastic second support beam is coupled to the floor member in a vertical in a vertical orientation and laterally displaced from the first support beam. A closed-cell non-organic foam panel is disposed in an upwardly facing channel of the floor member and in a first vertical channel of the first support beam and a second vertical channel of a second support beam. A non-organic plastic top beam is disposed on a top side of the foam panel.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The invention is to cover all modifications, equivalents, and alternatives falling within the scope of the invention as defined by the appended claims.

The various features or aspects discussed herein can also be combined in additional combinations and embodiments, whether or not explicitly discussed herein, without departing from the scope of the invention.

Figure 1:
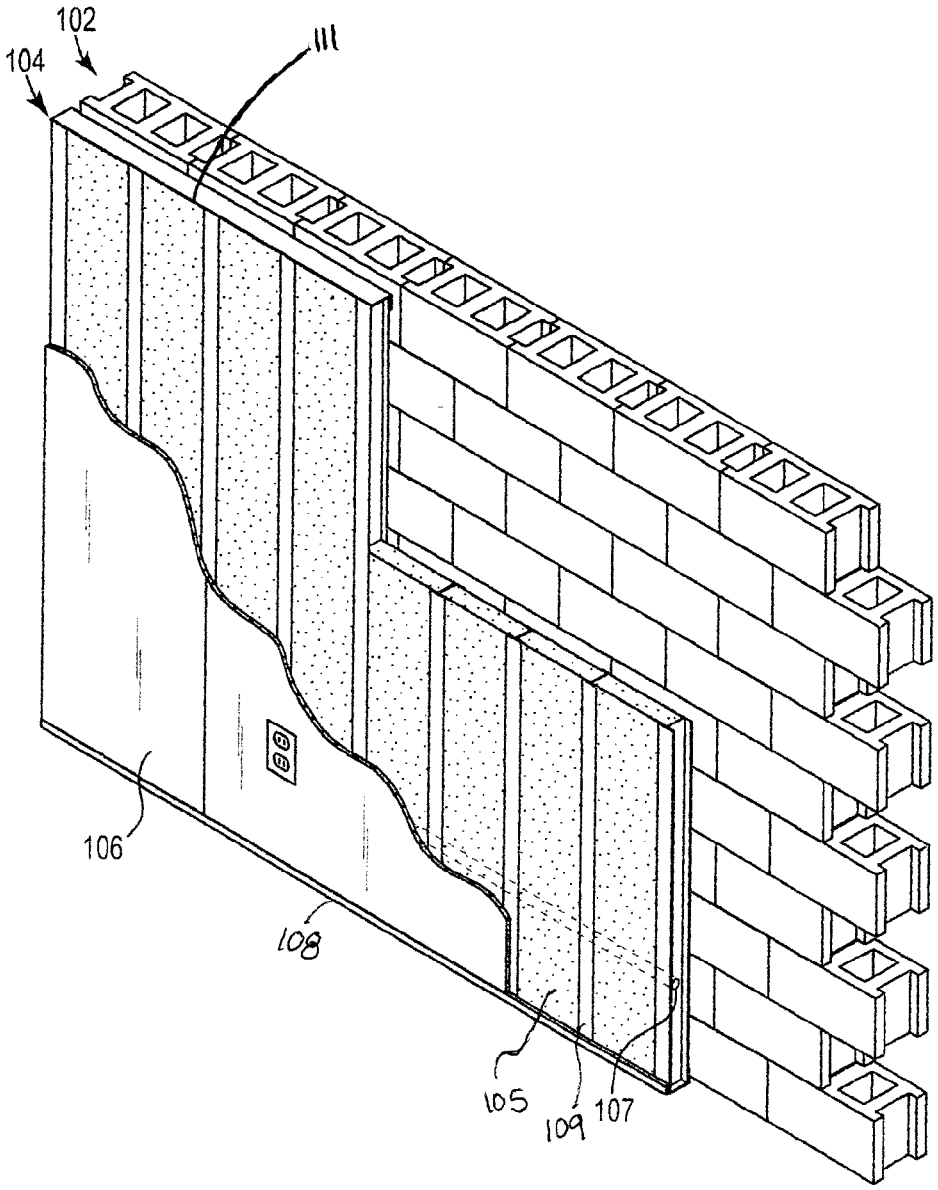
FIG. 1 is a perspective view of an anchored in-situ fabricated wall unit offset from the original basement wall according to certain embodiments.
Figure 2:
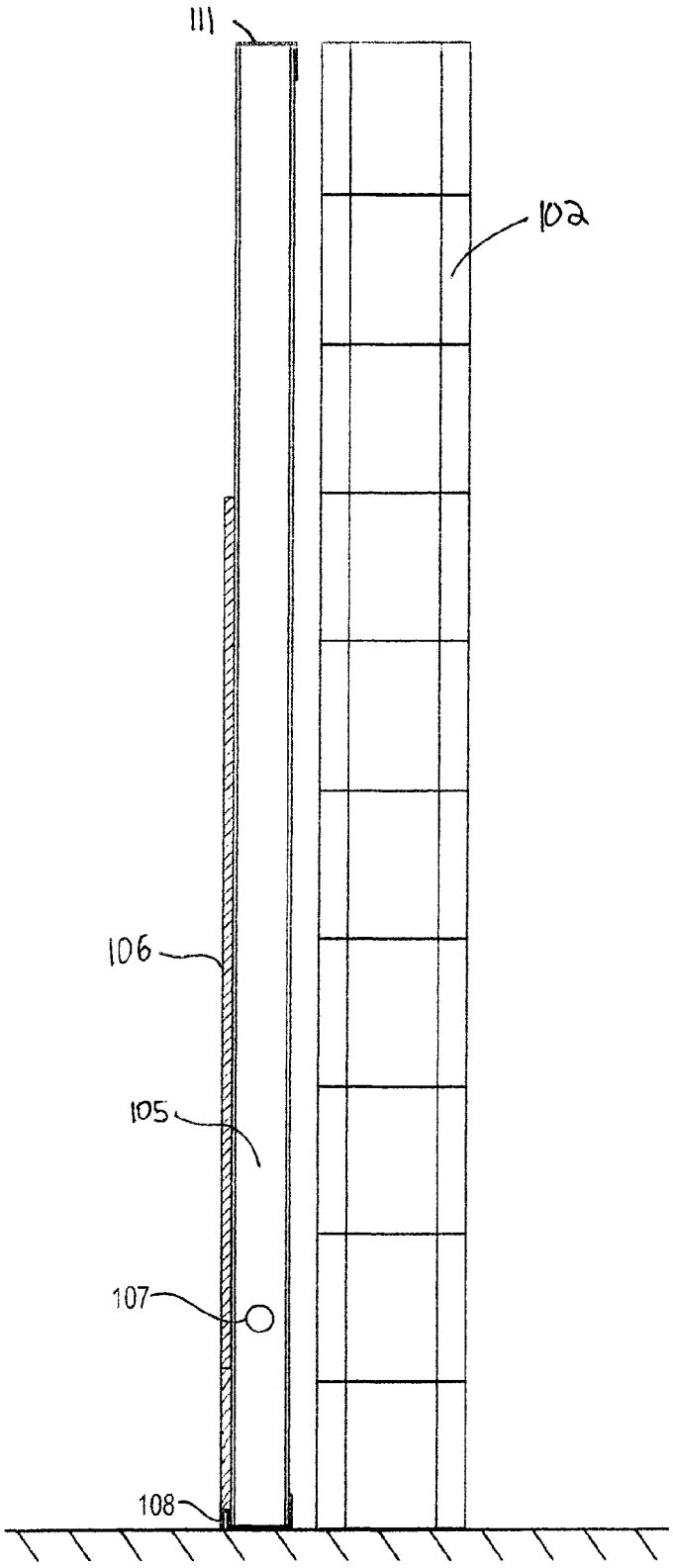
FIG. 2 is a side view of the embodiment depicted in FIG. 1 according to certain embodiments.
Figure 4:
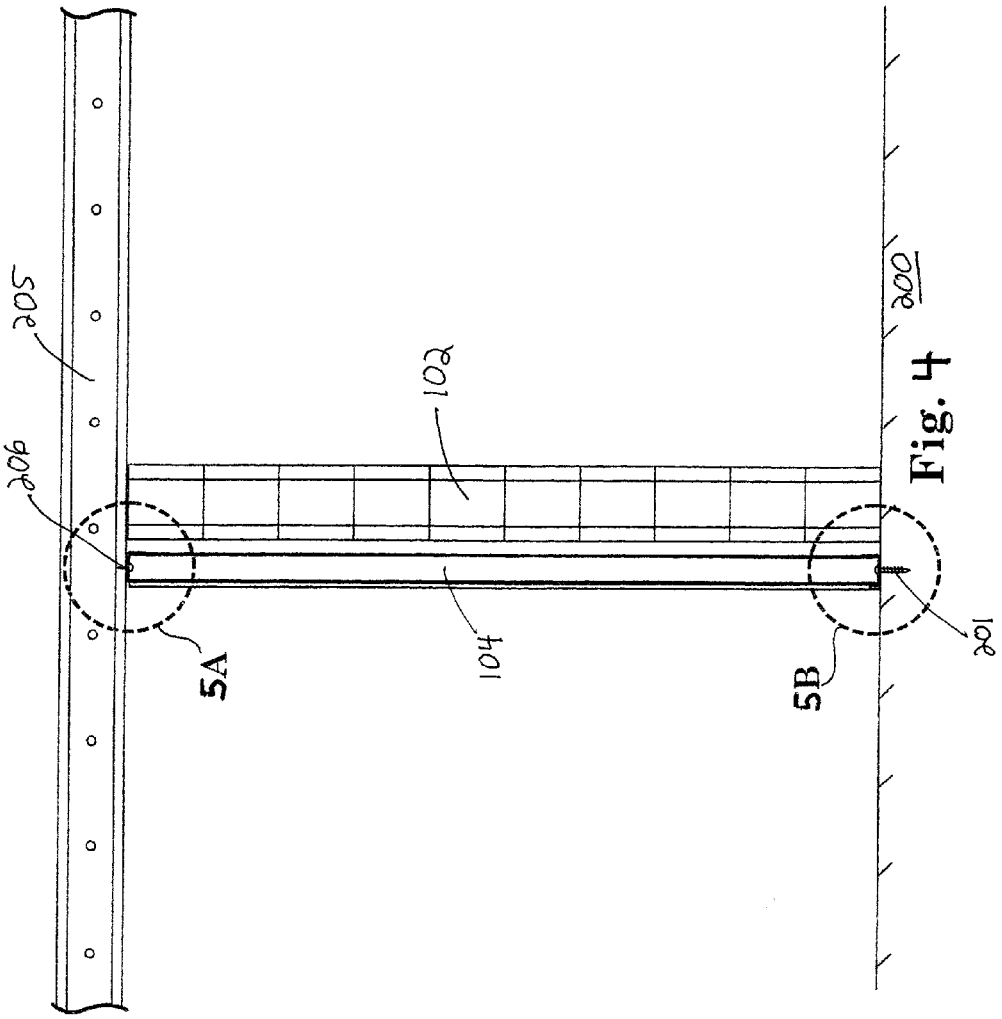
FIG. 4 is a schematic representation highlighting the anchoring of the in-situ fabricated wall unit to the ceiling and to the floor of a basement according to certain embodiments.
Figure 5B:
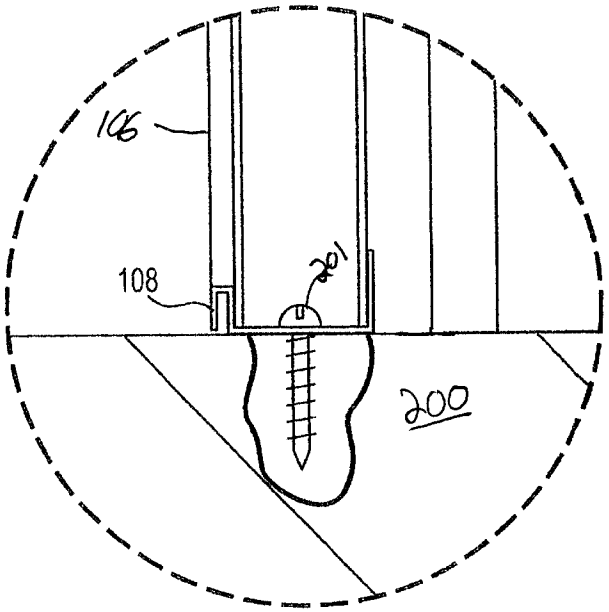
FIGS. 5A and 5B are detailed views of indicated portions of FIG. 4.
Figure 5A:
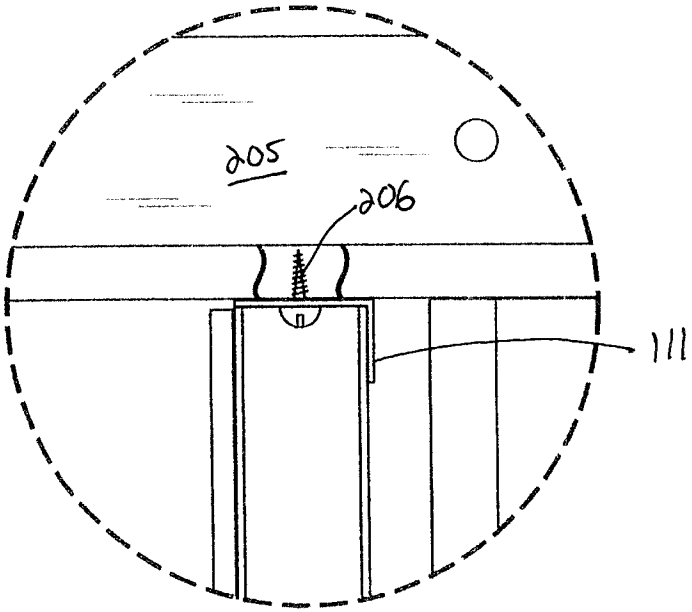

One example embodiment is depicted schematically in FIGS. 1-2 wherein an in-situ fabricated wall unit 104 is shown partially constructed and standing vertically adjacent to, but not touching, the concrete block wall 102, which forms the original basement wall. The in-situ fabricated wall unit 104 may be secured to the basement ceiling and floor by mechanical means as is depicted in FIGS. 4, 5A and 5B.

This free standing construction, (i.e. as used herein the phrase "free standing" means not attached, adhered to or supported by the original basement wall) of the in-situ fabricated wall unit allows the room designer the flexibility of placing in-situ fabricated walls anywhere within the confines of the basement.

Figure 7:
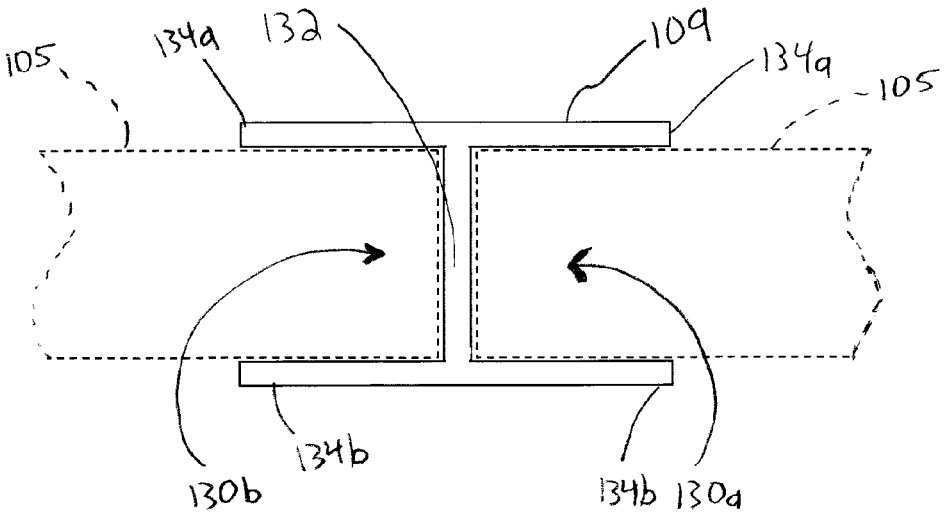
FIG. 7 is a top view of a vertical support beam according to certain embodiments.

In one embodiment of the present invention, the in-situ fabricated walls 104 may be comprised of individual foam panels 105, each being approximately 16 inches wide, disposed between opposing vertical support beams 109. The beams as shown, for example, in FIGS. 1 and 7 are I-beam shaped in cross-section so that they define adjacent channels 130*a* and 130*b* separated by a center rib 132. Laterally extending inner and outer flange portions 134*a* and 134*b* retain the foam panels from moving toward and away from the concrete block wall 102. The center ribs 132 of the opposing beams 105 prevent lateral movement of the foam panels 105.

A floor member or adaptor beam 108 laterally traverses along the floor and defines an upwardly facing channel for receiving the foam panel 105. The rear flange defining the channel is taller than the front flange. The front flange defines a top surface as shown in FIG. 2, which provides a rest for a wall covering 106.

A top or ceiling member 111 laterally traverses along the top of the panels and is generally L-shaped in cross-section. A horizontal portion of the member contacts the top of the panel 105, while the vertical portion abuts the rear of the panel 105 facing the concrete wall 102.

The respective beams and foam panels discussed above preferably fit together with minimal gaps of play. This results in a very rigid yet lightweight wall assembly.

The height of the foam panels 105 and side beams 109 can span typically between 4 and 10 feet to accommodate varying ceiling heights. However other lengths can be used without departing from the scope of the invention.

The wall system disclosed herein is modular and can be quickly and easily erected in-situ. As shown in FIGS. 1-2, 4 and 5B, the floor member 108 is secured to the floor 200, for example as shown in FIG. 5B using a concrete screw 201. Then individual 16-inch wide foam panels 105 are disposed side-by-side with the interlocking vertically-oriented I-beam stud elements 109 disposed between adjacent panels. Thus, a linear wall of extended length may easily and quickly be erected.

The in-situ fabricated wall system 104 can be mechanically constrained at the ceiling by means of the L shaped bracket or beam 111 attached to the ceiling joist 205 by a screw 206 as depicted in FIGS. 4 and 5A.

The front ledge or surface of the floor adapter 108 serves the dual purpose of supporting a sheet rock panel 106, or similar material overcoat panel, to the in-situ fabricated wall 104 as shown in FIGS. 1-2 and of raising the panel 106 above the floor level. A base board can be provided to cover the interior side of the seam between the panel and the ledge to present a more finished appearance to the basement.

Another feature, shown in FIGS. 1-2, are laterally-extending holes or passage 107 defined laterally through the foam panels 105 and vertical beams 109. The passage 107 defines a path through which cable, electrical wiring, phone lines, pipes and conduits can be routed laterally through the in-situ fabricated wall 104.

The foam panels 105 preferably comprise closed-cell polystyrene foam. Such material does not soak up water and is not organic, so it will resist mold growth and will not rot. The foam panels in one example embodiment are approximately two inches thick, which provides for a wall structure 104 having a thermal insulation R-10 value. In another embodiment, the foam panels 105 comprise closed-cell polystyrene foam with increased thickness up to and including 4 inches, which may yield a thermal insulation rating in the range of R-20. Other thicknesses and R-values can be employed without departing from the scope of the invention.

The various wall beams 108, 109 and 111 are formed from an extruded non-organic plastic material. Again, such material does not soak up water and will resist mold growth and will not rot due to the lack of organic matter in its composition. Thus, the wall system described herein is well-suited for use in basements or other locations that are prone to moisture infiltration.

The various beams can be secured together with various means, including plastic screws, adhesives and glues.

Figure 3A:
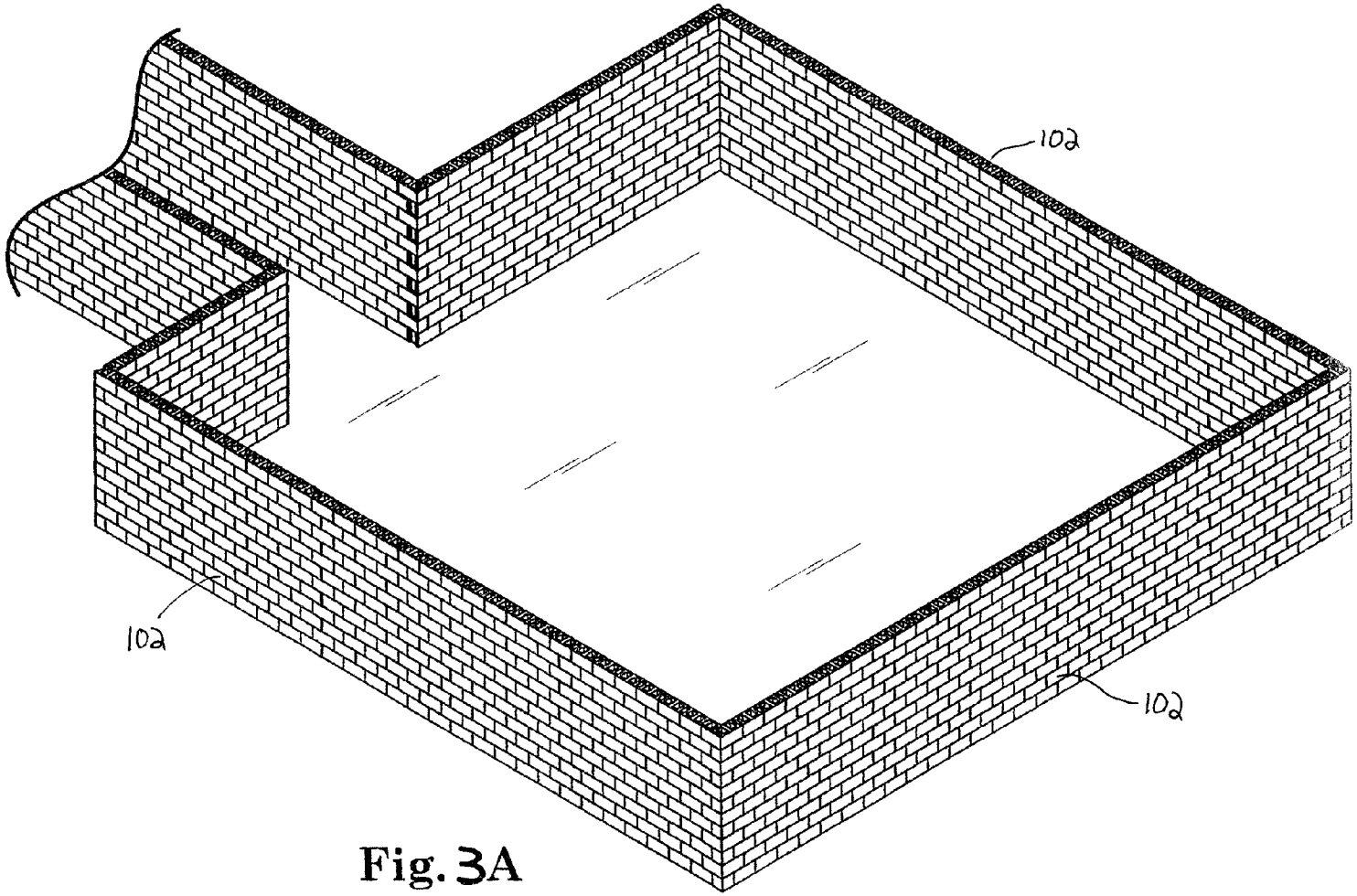
FIG. 3A is a depiction of an open area basement prior to the installation of an in-situ fabricated freestanding wall unit according to certain embodiments.
Figure 3B:
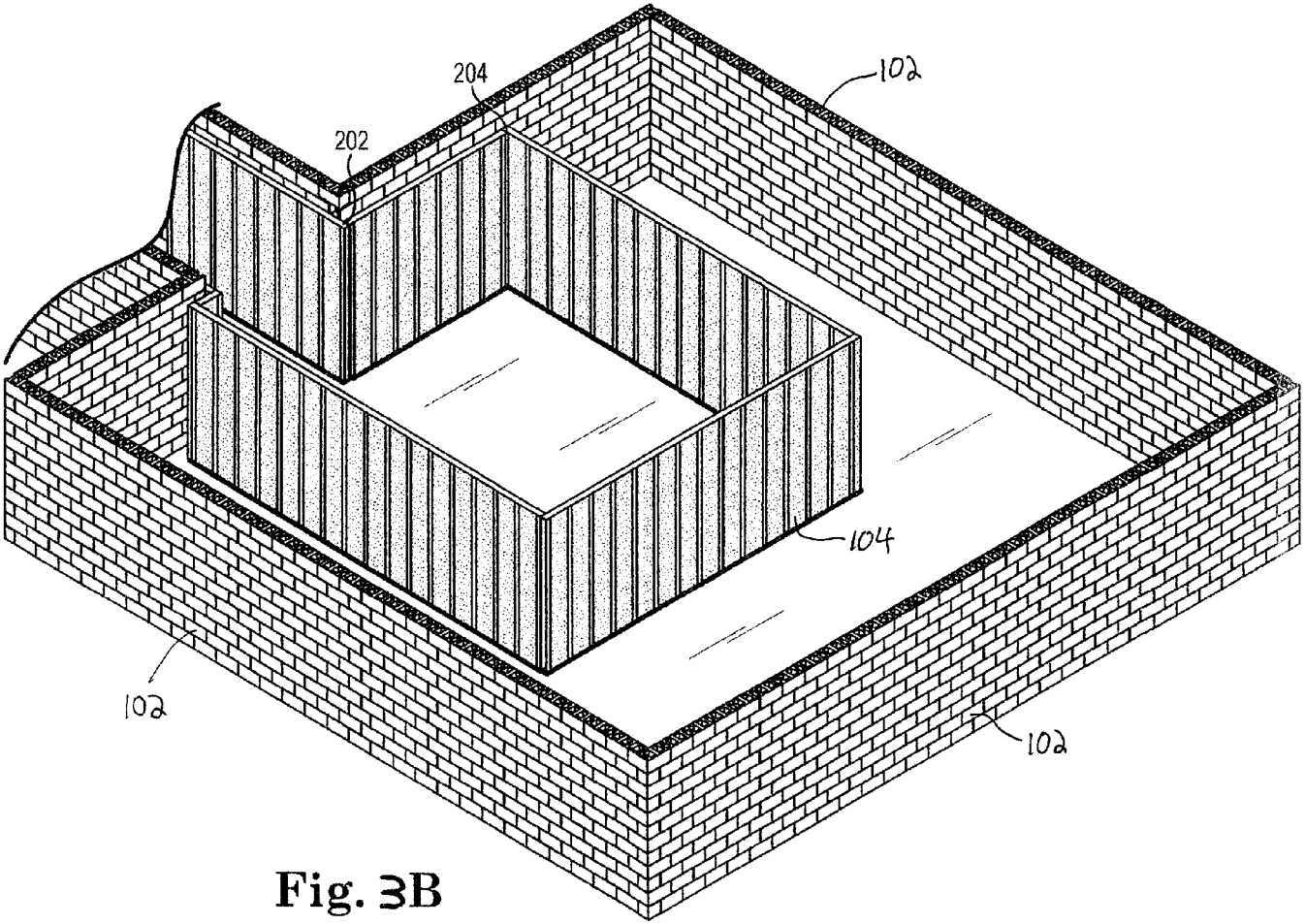
FIG. 3B is a depiction of the basement area of FIG. 3A after installation of an in-situ fabricated freestanding wall unit according to certain embodiments.

The wall system described herein can be used to form free-standing walls to subdivide a given room. For example, FIG. 3A depicts a generic rectangular basement whose perimeter is defined by concrete block walls 102. Using the wall system described herein, an in-situ free standing wall 104 can be formed within the basement as shown in FIG. 3B to subdivide the basement space.

Figure 6:
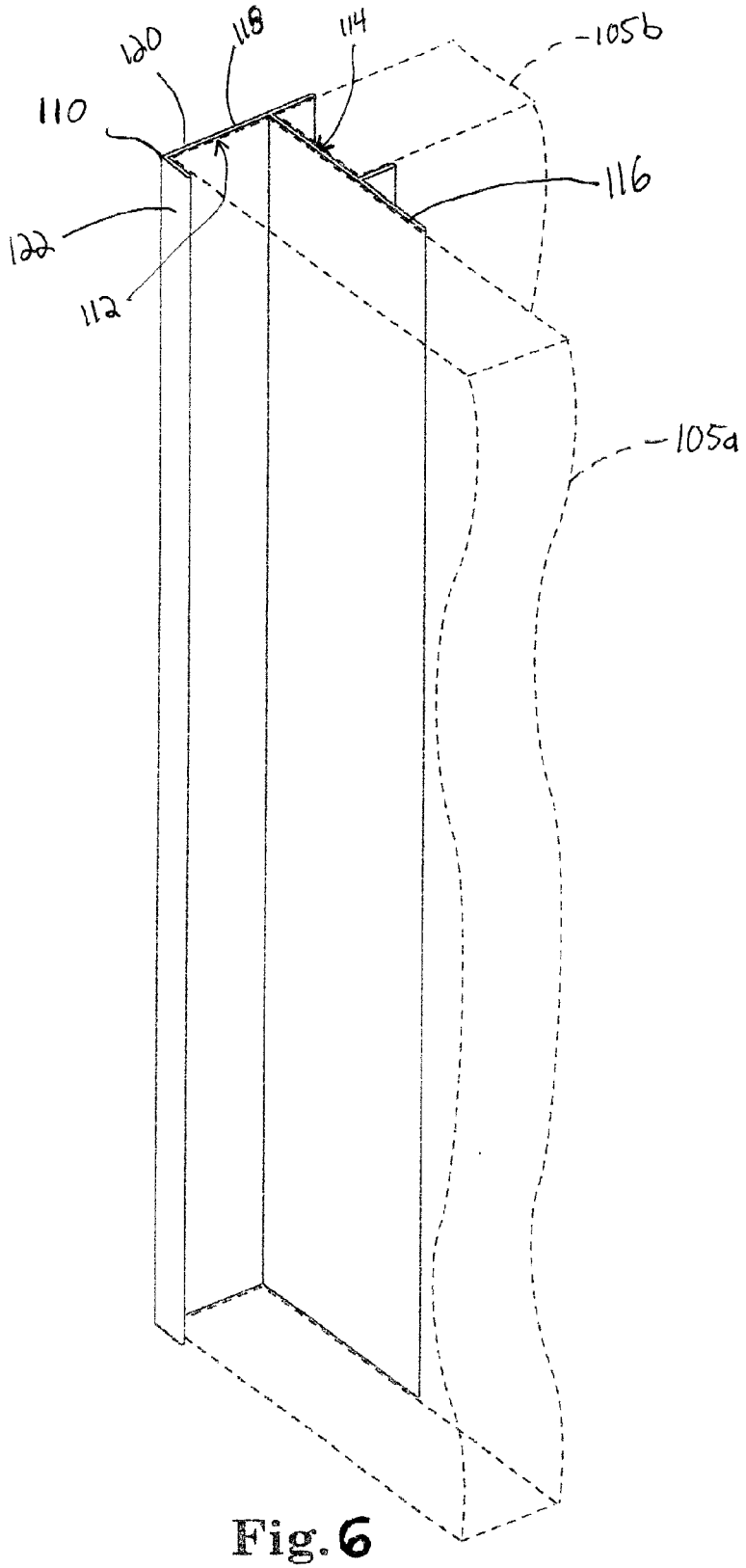
FIG. 6 is a perspective view of a right angle adaptor according to certain embodiments.

The ninety-degree corners are elected with a right angle or corner beam 110, which is shown in greater detail in FIG. 6. The corner beam is universal in that the same beam can be used to form both outside corners 202 and inside corners 204. The corner beam defines a first recess 112 in a first direction for receiving a first panel 105*a* and a second recess 114 in a ninety-degree offset direction for receiving a second panel 105*b*.

The first recess 112 is defined by the intersection of a dividing section 116 extending in the first direction from the major leg 118 of an L-shaped base portion 120. A minor leg 122 extends parallel to the dividing section and intersects the major leg 118 at a right angle, thereby defining the first recess 112.

The second recess 114 is defined by the dividing section 116 intersecting the major leg 118 at a right angle and by a mid-rib extending normally away from the dividing section.

The different inside and outside corner configurations can be formed with the same corner beam configuration by simply vertically inverting the corner beam 110 to match the desired inside or outside configuration.

Corner beams having angles other than ninety degrees may be provided without departing from the scope of the invention. For example, a corner beam configured to join foam panels at 72 degrees can be provided.

The wall system described herein also advantageously eliminates the traditional use of electrically conductive metal studs by using non-conductive materials throughout. Thus, the in-situ fabricated wall will reduce or eliminate spurious or unwanted electrical signals such as electromagnetic interference (EMI) from traversing through the wall 104. This enhanced EMI suppressing feature may be highly desirable when the in-situ wall is constructed in such a manner to partition off adjacent work areas both utilizing computers or other electronic equipment which may otherwise generate spurious EMI radiation which could interfere with devices in the adjacent area.

In addition to the technical details described above, there are practical advantages associated with the physical dimensions of the modular foam panels and walls described herein. For example, with a width of approximately 16 inches, the individual foam panels 105 can easily fit thru basement windows if available, thereby eliminating the need for the construction team to transport materials through the main floor living area and potentially making a mess or breaking valuable household goods.

When the in-situ fabricated wall is described herein is covered with sheetrock or gypsum board (depicted in FIG. 1) or similar material, the resultant structure has been demonstrated to have sufficient mechanical integrity such that typical household items as large flat screen TV's can be directly attached thereto without any additional support needed.

While the invention has been described in connection with what is presently considered to be the most practical and preferred example embodiments, it will be apparent to those of ordinary skill in the art that the invention is not to be limited to the disclosed example embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A basement wall assembly, comprising:

a horizontally-extending floor member including:

an upwardly facing channel;

a horizontal planar portion extending between a front vertical portion and a rear vertical portion, each of the front vertical portion and the rear vertical portion extending vertically upwards from a respective first and second opposing end of the horizontal planar portion;

a front horizontal ledge that extends horizontally forwardly from an uppermost end of the front vertical portion, the front horizontal ledge defining a planar ledge surface that is vertically disposed above the horizontal planar portion of the floor member; and a front face portion that extends vertically downwardly in a vertical plane from a forward most edge of horizontal ledge surface, wherein the front face portion has a vertical length dimension that is less than a vertical height of the front vertical portion of the floor member;

a first vertically-extending support beam coupled to the floor member, the first support beam defining laterally-adjacent channels separated by a center rib;

a foam panel disposed in the upwardly facing channel of the floor member and in one of the laterally-adjacent channels of the first support beam;

a top beam engaging a top side of the foam panel; and a wall board disposed on the front horizontal ledge of the floor member and being secured to the first vertically-extending support beam, wherein the floor member, first support beam and the top beam comprise a non-organic plastic material, and wherein the foam panel comprises a closed-cell non-organic foam material.

2. The assembly of claim 1, further comprising a second vertically-extending support beam coupled to the floor member, the second support beam defining laterally-adjacent channels separated by a center rib, the second support beam being laterally displaced along the floor member with respect to the first support beam, the second support beam comprising a non-organic plastic material.

3. The assembly of claim 1, wherein the top beam includes a horizontal portion disposed atop the foam panel and a vertical portion disposed behind the foam panel that extends vertically downward from the horizontal portion.

4. The assembly of claim 1, wherein the top beam is fastened to a ceiling member of a basement.

5. The system of claim 1, wherein the floor member is fastened to a concrete floor of a basement.

6. The system of claim 1, wherein the wall assembly comprises a free-standing wall.

7. The system of claim 1, wherein the foam panel includes a horizontally-oriented laterally-extending passage through the foam panel and through the first vertically-extending support beam.

8. The system of claim 1, further comprising a unitary corner beam, the corner beam including a first corner recess extending in a first direction, the first corner recess defined by a back surface spanning between a first side surface and a second side surface, each of the first and second side surfaces intersecting the back surface at a right angle, and a second recess extending in a second direction perpendicular to the first direction, the second recess defined by a continuation of the back surface past the second side surface, by the second side surface and by a third side surface extending perpendicularly from the second side surface, the third side surface oriented parallel to the back surface.

9. A wall system for basements, the system comprising:

a horizontally-extending floor member, the floor member defining an upwardly facing channel, the floor member including:

a horizontal planar portion extending between a front vertical portion and a rear vertical portion, each of the front vertical portion and the rear vertical portion extending vertically upwards from a respective first and second opposing end of the horizontal planar portion;

a front horizontal ledge that extends horizontally forwardly from an uppermost end of the front vertical portion, the front horizontal ledge defining a planar ledge surface that is vertically disposed above the horizontal planar portion of the floor member; and a front face portion that extends vertically downwardly in a vertical plane from a forward most edge of horizontal ledge surface, wherein the front face portion has a vertical length dimension that is less than a vertical height of the front vertical portion of the floor member;

a first vertically-extending support beam coupled to the floor member, the first support beam defining laterally-adjacent channels separated by a center rib;

a second vertically-extending support beam coupled to the floor member, the second support beam defining laterally-adjacent channels separated by a center rib, the second support beam being laterally displaced along the floor member with respect to the first support beam;

a foam panel disposed in the upwardly facing channel of the floor member and in one of the laterally-adjacent channels of the first support beam and in one of the laterally-adjacent channels of the second support beam; and a wall board disposed on the front horizontal ledge of the floor member and being secured to the first vertically-extending support beam, wherein the floor member, first support beam and second support beam comprise a non-organic plastic material, and wherein the foam panel comprises a closed-cell non-organic foam material.

10. The system of claim 9, further comprising a top beam, the top beam including a horizontal portion disposed atop the foam panel and a vertical portion disposed behind the foam panel that extends vertically downward from the horizontal portion.

11. The system of claim 10, wherein the top beam is fastened to a ceiling member of the basement.

12. The system of claim 9, wherein the floor member is fastened to a concrete floor of the basement.

13. The system of claim 9, wherein the wall system comprises a free-standing wall.

14. The system of claim 9, wherein the foam panel includes a horizontally-oriented laterally-extending passage through the foam panel and through the first vertically-extending support beam.

15. The system of claim 9, further comprising a unitary corner beam, the corner beam including a first corner recess extending in a first direction, the first corner recess defined by a back surface spanning between a first side surface and a second side surface, each of the first and second side surfaces intersecting the back surface at a right angle, and a second recess extending in a second direction perpendicular to the first direction, the second recess defined by a continuation of the back surface past the second side surface, by the second side surface and by a third side surface extending perpendicularly from the second side surface, the third side surface oriented parallel to the back surface.

16. A wall system for basements, the system comprising:

a horizontally-extending floor member, the floor member including:

an upwardly facing channel;

a horizontal planar portion extending between a front vertical portion and a rear vertical portion, each of the front vertical portion and the rear vertical portion extending vertically upwards from a respective first and second opposing end of the horizontal planar portion;

a front horizontal ledge that extends horizontally forwardly from the front vertical portion, the front horizontal ledge defining a planar ledge surface that is vertically disposed above the horizontal planar portion of the floor member; and a front face portion that extends vertically downwardly in a vertical plane from a forward most edge of horizontal ledge surface, wherein the front face portion has a vertical length dimension that is less than a vertical height of the front vertical portion of the floor member;

a first vertically-extending support beam disposed within the upwardly facing channel of the floor member, the first support beam comprising a pair of parallel oriented end surfaces separate by a center rib, thereby defining a first channel on a first longitudinal side of the center rib and a second channel on a second longitudinal side of the center rib, each of the first and second channels being laterally-adjacent to one another;

a second vertically-extending support beam disposed within the upwardly facing channel of the floor member and laterally displaced along the floor member with respect to the first support beam, the second vertically-extending support beam comprising a pair of parallel oriented end surfaces separated by a center rib, thereby defining a first channel on a first longitudinal side of the center rib and a second channel on a second longitudinal side of the center rib, each of the first and second channels being laterally-adjacent to one another;

a foam panel disposed in the upwardly facing channel of the floor member and in the first channel of the first support beam and in a second channel of the second support beam; and a wall board disposed on the front horizontal ledge of the floor member and secured to the first vertically-extending support beam, wherein the floor member, first support beam and second support beam comprise a non-organic plastic material, and wherein the foam panel comprises a closed-cell non-organic foam material.

17. The system of claim 16, further comprising a unitary corner beam, the corner beam including:

a first corner recess extending in a first direction, the first corner recess defined by a back surface spanning between a first side surface and a second side surface, each of the first and second side surfaces intersecting the back surface at a right angle; and a second recess extending in a second direction perpendicular to the first direction, the second recess defined by a continuation of the back surface past the second side surface, by the second side surface and by a third side surface extending perpendicularly from the second side surface, the third side surface oriented parallel to the back surface.

* * * * *